United States Patent [19]

Otsuka et al.

[11] 4,302,848

[45] Dec. 1, 1981

[54] METHOD FOR WEARING AND TAKING OFF PROTECTIVE SUIT

[75] Inventors: Katsuyuki Otsuka, Mito; Jin Ohuchi, Tokai; Shizuo Arita, Tokyo, all of Japan

[73] Assignees: Doryokuro Kakunenryo Kaihatsu Jigyodan; Fujikura Rubber Works, Ltd., both of Tokyo, Japan

[21] Appl. No.: 138,362

[22] Filed: Apr. 8, 1980

[30] Foreign Application Priority Data

Apr. 9, 1979 [JP] Japan ..... 54-42900

[51] Int. Cl.[3] ..... A41D 13/00

[52] U.S. Cl. ..... 2/2; 128/201.29

[58] Field of Search ..... 2/2, 2.1 R, 2.1 A, 69, 2/69.5; 128/201.29, 202.11

[56] References Cited

U.S. PATENT DOCUMENTS

| | | | |
|---|---|---|---|
| 2,813,022 | 11/1957 | Moulthrop | 2/2 |
| 2,985,129 | 5/1961 | Kirkpatrick | 2/2 X |
| 3,744,055 | 7/1973 | Brendgord | 2/2 |

FOREIGN PATENT DOCUMENTS

| | | | |
|---|---|---|---|
| 2557777 | 6/1977 | Fed. Rep. of Germany | 2/2 |
| 1000674 | 8/1965 | United Kingdom | 2/2 |

*Primary Examiner*—Louis Rimrodt
*Attorney, Agent, or Firm*—Fleit & Jacobson

[57] ABSTRACT

A method for wearing and taking off a protective suit which is used when entering the inside of a working zone segregated from the outside thereof. The protective suit has a cylindrical portion made of a film-like fusible material and is designed so that one can get into or out of the suit by passing through the cylindrical portion. When wearing the protective suit, one gets into the suit by passing through the cylindrical portion, with the protective suit being kept joined to an entrance/exit section of the working zone, and then part of the cylindrical portion is fused and closed to segregate the inside of the suit from the outside thereof while sealing the entrance/exit section with a pouch-like member. When taking off the protective suit, the cylindrical portion on the protective suit side and the pouch-like portion on the entrance/exit section side are superposed one on the other and fused at the part provided with an anti-fusion tape applied on the interior side of the cylindrical portion and, after cutting the fused portion, one gets out of the suit by passing through that part of the cylindrical portion which was not fused owing to the presence of said anti-fusion tape.

2 Claims, 2 Drawing Figures

1
2
3
4
5
6
7
8
a
b
c
d

METHOD FOR WEARING AND TAKING OFF PROTECTIVE SUIT

BACKGROUND OF THE INVENTION

This invention relates to a method for wearing and taking off a protective suit which is used when entering a special contaminated zone or other working areas such as "clean room" segregated from a general on-limits area.

Wearing of a protective suit is required for working in a radioactive material contaminated zone in atomic power facilities, particularly in an area where plutonium is treated. Of course, such protective suit must be worn not only for ordinary works in the off-limits zones but also when emergency entrance is required in the event of an accident. A clothing for insulating the worker from the outer atmosphere is also required in an area where a noxious substance is treated or in a so-called clean room. When entering a working area such as a contaminated zone or a clean room by wearing such protective suit, it is important to effect perfect segregation between the inside and outside of the working area as well as the inside and outside of the protective suit, and particularly perfect shut-off or confinement of contaminant is imperative when wearing or taking off the protective suit.

Various methods are known for wearing and take-off of the protective suit used for working in the specific areas such as radioactive material contaminated zones, and typical of these methods are a so-called "la carene" system and an over-suit system. The former system is a method in which the worker gets into or out of the protective suit through a ring-shaped double port. This method, however, has a serious structural defect that the contaminant around the port could spread into the non-contaminated area. The over-suit system is a method in which the worker passes two or three independent chambers before entering the contaminated zone and he is required to wear or take off one over-suit in each of said chambers. This method takes a long time until entering or leaving the working zone and, also, since the over-suits are all disposable or "throw-away" items, they add up to the volume of waste material.

SUMMARY OF THE INVENTION

An object of this invention is to eliminate the above-mentioned defects of the prior arts and to provide a method for wearing and taking off a protective suit, which is capable of effecting perfect segregation between the inside and outside of the working zone as well as the inside and outside of the protective suit.

Another object of this invention is to provide a method for wearing and taking off a protective suit, wherein perfect confinement of the contaminant is obtained when wearing or taking off the protective suit.

Other object of this invention is to provide a method for wearing and taking off a protective suit, which allows accomplishment of the suit wearing and taking-off operation in a short time.

Further object of this invention is to provide a method for wearing and taking off a protective suit, wherein the protective suit employed can be used repeatedly and is adaptable in any existing facilities.

According to the present invention, there is provided a method for wearing and taking off a protective suit which is used when a worker enters the inside of a working zone segregated from the outside thereof. The protective suit used in this invention has a cylindrical portion made of a film-like material, such as polyvinyl chloride or polyethylene, which has sufficient shielding or checking capacity against radioactive materials and other noxious substances and is also fusible by a usual sealing method such as high-frequency sealing, heat sealing, etc. One end of the cylindrical portion is joined to the protective suit so that the worker can get into or out of the suit by passing through said cylindrical portion.

When wearing the protective suit, the worker gets into the suit by passing through the cylindrical portion, with the other end of the cylindrical portion being kept joined to an entrance/exit section or port provided in a wall which segregates the inside of the working zone from the outside thereof. Then, at least one part of the cylindrical portion is fused and closed to segregate the inside of the suit from the outside thereof. The cylindrical portion is then cut so as to maintain the segregation between the inside and outside of the working zone as well as the inside and outside of the protective suit. Thus, a pouch-like portion formed by a part of the cylindrical portion is provided to seal the entrance/exit section, and the protective suit carrying the residual part of the cylindrical portion is separated from the entrance/exit section.

When the worker wants to divest himself of the protective suit, the cylindrical portion on the protective suit side and the pouch-like portion on the entrance/exit section side are superposed one on the other and fused at the superposed portion provided with an anti-fusion tape applied on the interior side of the cylindrical portion. After cutting the fused portion, the worker gets out of the suit by passing through that part of the cylindrical portion which has not been fused owing to the presence of said anti-fusion tape.

In another embodiment of this invention, it is used a protective suit which has a cylindrical portion and a cylindrical joining member provided on the outer periphery of the cylindrical portion. One end of the cylindrical portion is joined to the protective suit, and the open end of the joining member is to be joined to the entrance/exit section. This joining member is made of a film-like fusible material similar to that of the cylindrical portion.

The worker gets into the suit by passing through the cylindrical portion, with the open end of the joining member being kept joined to the entrance/exit section. Then, the other end of the cylindrical portion is fused and closed to segregate the inside of the suit from the outside thereof. A separate pouch-like member made of a film-like fusible material is then provide to seal the entrance/exit section while removing the joining member from the entrance/exit section. Thus, segregation between the inside and outside of the working zone is maintained, and the protective suit carrying both the cylindrical portion and the joining member is separated from the entrance/exit section.

Also in this embodiment, the worker can get out of the protective suit in the same manner as in the first mentioned embodiment.

DESCRIPTION OF THE PREFERRED EMBODIMENTS

Figures 1A, 1B, 1C, 1D, 1E, 1F:
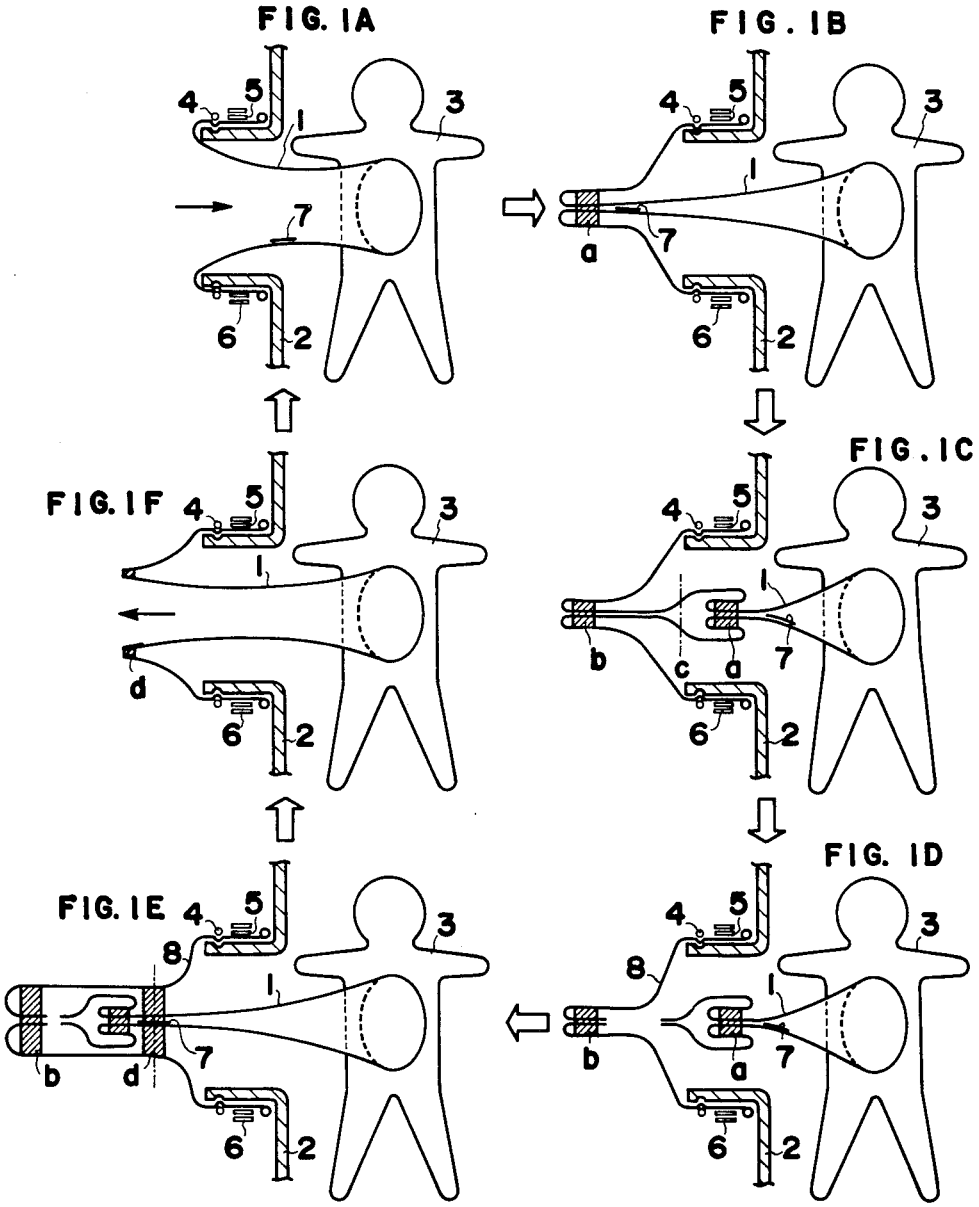
FIGS. 1(A) to (F) are illustrations showing an embodiment of the protective suit wearing and taking-off method according to this invention.

Referring to FIGS. 1(A) to (F), there is shown one embodiment of this invention. In this embodiment, the film-like cylindrical portion 1 is designed to concurrently serve as a connection to the entrance/exit section or port 2 of the working zone. Namely, an end of the film-like cylindrical portion 1 is joined to the protective suit 3 so that the worker can get into the suit by passing through said cylindrical portion 1, with the other end of said cylindrical portion 1 being secured to the entrance/exit section 2 by means of a combination of an O-ring 4, a packing 5 and fastening means 6 (see FIG. 1(A) ). Thus, the worker can get into the protective suit 3 by passing through said cylindrical portion 1. Before or after the worker has properly got into the protective suit 3, an adhesive tape 7 is stuck to an inside part of the cylindrical portion 1. This adhesive tape 7 is made of a material, such as tetrafluoroethylene resin or paper, which is not fusion bonded with the cylindrical portion 1 when part of the cylindrical portion is fused, and such anti-fusion tape is applied along a length substantially half or more of the circumferential length of the cylindrical portion.

After the worker has duly got into the protective suit 3, a part of the cylindrical portion 1 is folded back so that the film lies in four layers at the portion indicated by slant lines a as shown in FIG. 1(B), and this portion a is fused.

Another part of the cylindrical portion 1 is folded back to form a four-layer laminate indicated by slant lines b as shown in FIG. 1(C) and this portion b is fused, and then the cylindrical portion 1 is cut along the chain dotted line c. Then the worker clad in the protective suit 3 folds back the cut cylindrical portion 1 before his breast and can now begin his work.

Respiration of the worker in the protective suit insulated from the outer atmosphere can be secured in the following ways:

(a) The worker carries with him an air or oxygen cylinder, and the breathes of the worker are released out of the protective suit through a filter secured to the suit.

(b) The worker equips himself with an oxygen generator capable of generating oxygen by a chemical reaction. Thus, the cycle of expiration→oxygen generation→inspiration is repeated in the protective suit. The reaction heat produced by the oxygen generation is released out of the suit by a heat exchanger provided to the protective suit.

(c) The protective suit is communicated with the atmosphere or an air source outside the working zone by an air line hose to allow normal respiration of the worker.

When the worker wants to divest himself of the protective suit 3 after completion of the work, he spreads out the folded cylindrical portion 1 before his breast and brings it toward the other cylindrical portion fixed to the entrance/exit section 2, that is, the pouch-like portion 8 as shown in FIG. 1(D).

Then the portion d where the anti-fusion adhesive tape 7 has been stuck is placed in four layers, and the cylindrical portion 1 and the pouch-like portion 8 are fused together along a width smaller than the tape width and the fused portion is cut at its middle part as shown in FIG. 1(E). Since the parts at both sides of the adhesive tape 7 are not fused, the worker can get out of the suit through this portion (FIG. 1(F)). The condition at this stage is same as that of (A), so that, if desired, the worker can again wear the same protective suit 3 by repeating the above-said procedure.

FIGS. 2(A) to (F) show another embodiment of this invention. In this embodiment, a cylindrical joining member 1*b* for the entrance/exit section 2 of the working zone and the protective suit 3 is provided outside of the cylindrical portion 1*a* made of a film-like material. It will be seen that an end of the joining member 1*b* is secured to the protective suit 3 while the other end is fixed to the entrance/exit section 2 by means of an O-ring 4, a packing 5 and a fastening means 6. The fusible film-made cylindrical portion 1*a* is joined at its one end along the inner periphery of the joining member 1*b* while the other end of said cylindrical portion 1*a* opens to the general, on-limits area side, so that the worker can get into the protective suit 3 by passing through said film-like cylindrical portion 1*a* (see FIG. 2(A)). Before or after entrance of the worker into the protective suit 3, an anti-fusion adhesive tape 7 is stuck to an inside part of the cylindrical portion 1*a* as in the case of the preceding embodiment.

Figure 2A:
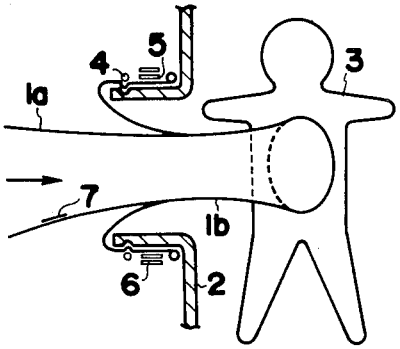
FIGS. 2(a) to (F) are illustrations showing another embodiment of this invention.
Figure 2B:
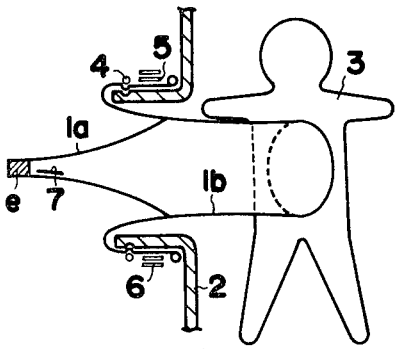
Figure 2F:
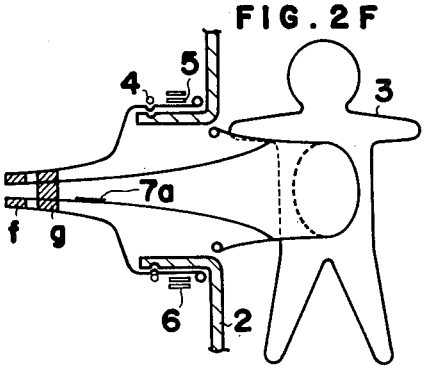

After the worker has duly got into the protective suit 3, the film is placed in two layers at the slant-lined portion e and fused as shown in FIG. 2(B).

Figure 2C:
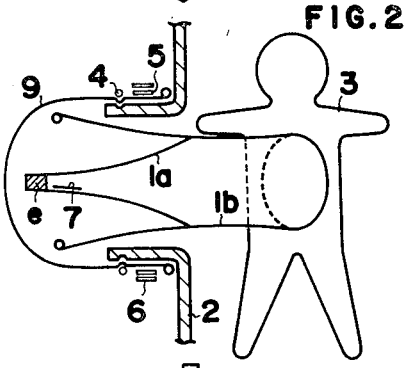

Then a separate pouch-like body 9 is provided to the entrance/exit section 2 as shown in FIG. 2(C) and the protective suit 3 is simultaneously separated from the entrance/exit section 2. This pouch-like body 9 is made of a fusible material like the cylindrical portion 1*a*. The worker then folds back the cylindrical portion 1*a* and the joining member 1*b* near his breast and begins his work.

Figure 2E:
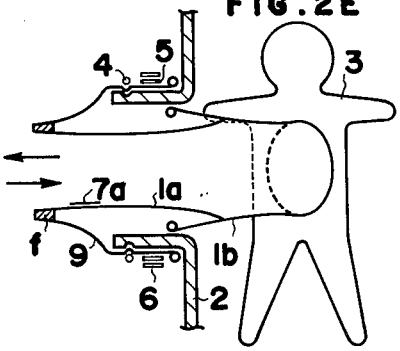
Figure 2D:
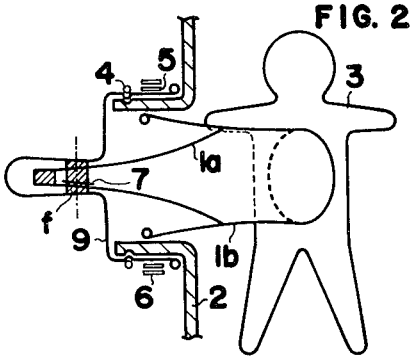

When the worker wants to divest himself of the protective suit 3 after completion of the work, he spreads out the folded cylindrical portion 1*a* and brings the end of the cylindrical portion 1*a* toward the middle part of the inside of the pouch-like body 9, and then the part provided with the adhesive tape 7 is paced in four layers at its portion f and this portion is fused and then cut at the middle part thereof as shown in FIG. 2(D).

The inside of the pouch-like body 9 and the outside of the cylindrical portion 1*a* are fused together, but since the inside of the cylindrical portion 1*a* is not fused because of the presence of the adhesive tape 7, the worker can leave through this section (FIG. 2(E)).

When it is desired to gain wear the protective suit 3, the worker gets into the protective suit 3 through the cylindrical portion 1*a* in the condition shown in FIG. 2(E). In this case, another adhesive tape 7*a* is stuck on the interior side of the cylindrical portion 1*a* as in the case of FIG. 2(A). Then the portion indicated by slant lines g is placed in four layers and fused as shown in FIG. (F) and then the operation of FIG. 2(C) is repeated, followed by the same process as said above.

As understood from the foregoing description of the two typical embodiments of this invention, it has been ascertained that the present invention allows very easy wearing and taking-off of the protective suit and repeated use of such protective suit owing to the features of this invention which comprises the use of a protective suit provided with a film-like cylindrical portion, with part of said cylindrical portion being folded back into a form such as said above and fused while preventing fusion of another part of the cylindrical portion by the use of an adhesive tape.

The scope of this invention is not limited to the above-described embodiments but various changes and modifications can be made in the mode of fold-back of the cylindrical portion and other matters without departing from the spirit and scope of the invention.

According to this invention which provides a method of wearing and taking off a protective suit constituted as described above, there are provided many advantages such as mentioned below:

(a) Since the perfect segregation between the inside and outside of the working zone as well as the inside and outside of the protective suit is provided at the time of wearing or taking-off of the suit by the worker and during the work, the protective suit employed in this invention can be used safely and effectively for the works in a zone where an alpha emitter such as plutonium is treated.

(b) There is required no air-locked independent section (room) when entering or leaving the working zone and also wearing and take-off of the protective suit are very easy. Further, there is no need of wearing two or more protective suits one over another. Therefore, when performing a work in the working zone by wearing the protective suit, the time required for entrance into and exit from the working zone is greatly shortened and hence the actual working time is prolonged. Further, since there is no need of wearing two or more protective suits one over another, one can prepare a protective suit best fit for the type of the work to be done and can therefore perform the work at high efficiency. For the same reasons, the method of this invention also proves ideal for emergency entrance into the working zone in the event of an accident.

(c) Since the protective suit can be used repeatedly, no increment of waste material is caused by such suit.

(d) Since no specific instrument nor any large-scale apparatus or tooling is needed at the entrance/exit section when wearing or taking off the protective suit, this invention can well be applied to any existing facilities.

What is claimed:

1. A method for wearing and taking off a protective suit which is used when a worker enters the inside of a working zone segregated from the outside thereof, characterized in that said protective suit has a cylindrical portion made of a film-like fusible material, with one end of said cylindrical portion being joined to the protective suit so that the worker can get into or out of the suit by passing through said cylindrical portion;

that, when wearing the protective suit, the worker gets into the suit by passing through said cylindrical portion, with the other end of the cylindrical portion being kept joined to an entrance/exit section provided in a wall which segregates the inside of the working zone from the outside thereof, and then at least one part of the cylindrical portion is fused and closed to segregate the inside of the suit from the outside thereof, and then the cylindrical portion is cut so as to maintain the segregation between the inside and outside of the working zone as well as the inside and outside of the protective suit, thereby providing a pouch-like portion formed by a part of the cylindrical portion to seal the entrance/exit section and separating the protective suit carrying the residual part of the cylindrical portion from the entrance/exit section; and that, when taking off the protective suit, the cylindrical portion on the protective suit side and the pouch-like portion on the entrance/exit section side are superposed one on the other and fused at the superposed portion provided with an anti-fusion tape applied on the interior side of the cylindrical portion and, after cutting the fused portion, the worker gets out of the suit by passing through that part of the cylindrical portion which has not been fused owing to the presence of said anti-fusion tape.

2. A method for wearing and taking off a protective suit which is used when a worker enters the inside of a working zone segregated from the outside thereof, characterized in that said protective suit has a cylindrical portion and a cylindrical joining member provided on the outer periphery of the cylindrical portion, the cylindrical portion and the cylindrical joining member are both made of a film-like fusible material, and one end of the cylindrical portion is joined to the protective suit so that the worker can get into or out of the suit by passing through said cylindrical portion;

that, when wearing the protective suit, the worker gets into the suit by passing through said cylindrical portion, with the open end of said joining member being kept joined to an entrance/exit section provided in a wall which segregates the inside of the working zone from the outside thereof, and then the other end of the cylindrical portion is fused and closed to segregate the inside of the suit from the outside thereof, and then a separate pouch-like member made of a film-like fusible material is provided to seal the entrance/exit section while removing the joining member from the entrance/exit section, thereby maintaining segregation between the inside and outside of the working zone and separating the protective suit carrying both the cylindrical portion and the joining member from the entrance/exit section; and that, when taking off the protective suit, the cylindrical portion on the protective suit side and the pouch-like portion on the entrance/exit section side are superposed one on the other and fused at the superposed portion provided with an anti-fusion tape applied on the interior side of the cylindrical portion and, after cutting the fused portion, the worker gets out of the suit by passing through that part of the cylindrical portion which has not been fused owing to the presence of said anti-fusion tape.

* * * * *